US012761004B2

(12) United States Patent
Tyrell et al.

(10) Patent No.: US 12,761,004 B2
(45) Date of Patent: Oct. 13, 2026

(54) RANGE EXTENSION DEVICE

(71) Applicant: BAE SYSTEMS PLC, London (GB)

(72) Inventors: Thomas William Tyrell, Usk Monmouth (GB); Andrew David Williams, Usk Monmouth (GB); Benjamin Daniel Worrall, Usk Monmouth (GB)

(73) Assignee: BAE SYSTEMS PLC, London (GB)

( * ) Notice: Subject to any disclaimer, the term of this patent is extended or adjusted under 35 U.S.C. 154(b) by 0 days.

(21) Appl. No.: 19/112,053

(22) PCT Filed: Aug. 29, 2023

(86) PCT No.: PCT/GB2023/052228

§ 371 (c)(1),
(2) Date: Mar. 14, 2025

(87) PCT Pub. No.: WO2024/056988

PCT Pub. Date: Mar. 21, 2024

(65) Prior Publication Data

US 2026/0092764 A1 Apr. 2, 2026

(30) Foreign Application Priority Data

Sep. 14, 2022 (GB) ..... 2213429

(51) Int. Cl.
*F42B 10/38* (2006.01)
*F42B 10/40* (2006.01)
(Continued)

(52) U.S. Cl.
CPC ..... *F42B 10/38* (2013.01); *F42B 10/40* (2013.01); *F42B 15/10* (2013.01); *F42B 15/36* (2013.01)

(58) Field of Classification Search
CPC ..... F42B 10/38; F42B 10/40; F42B 15/00; F42B 15/36; F42B 15/10
(Continued)

(56) References Cited

U.S. PATENT DOCUMENTS 4,213,393 A * 7/1980 Gunners ..... F42B 10/40 102/374
4,846,071 A * 7/1989 Franzen ..... F42B 10/40 102/490
(Continued)

FOREIGN PATENT DOCUMENTS

EP 0268566 A2 5/1988
EP 0285184 A1 10/1988
(Continued)

OTHER PUBLICATIONS

International Search Report and Written Opinion received for PCT/GB2023/052228. Mail Date: Nov. 2, 2023. 10 pages.
(Continued)

*Primary Examiner* — James S Bergin
(74) *Attorney, Agent, or Firm* — Arcane Law PLLC

(57) ABSTRACT

A range extension device, capable in use of being reversibly engaged to a body of an artillery carrier shell, said shell comprising a payload cavity, said range extension device comprising an internal cavity comprising at least one energetic material charge, and an igniter, wherein the range extension device comprises a first region with an aperture which faces rearwardly, and second region with a closed end, wherein the closed end in use extends into the payload cavity of the carrier shell.

12 Claims, 4 Drawing Sheets

(51) Int. Cl.
*F42B 15/10* (2006.01)
*F42B 15/36* (2006.01)

(58) Field of Classification Search
USPC ..... 102/490
See application file for complete search history.

(56) References Cited

U.S. PATENT DOCUMENTS

| | | | | | |
|---|---|---|---|---|---|
| 5,353,711 | A * | 10/1994 | Botticelli | F42B 17/00 | 102/490 |
| 5,886,289 | A * | 3/1999 | Nixon | F02K 9/95 | 102/490 |
| 6,158,349 | A * | 12/2000 | Altenau | F42B 10/40 | 102/490 |
| 7,360,355 | B1 * | 4/2008 | Gadiot | F02K 9/44 | 102/490 |
| 7,578,238 | B1 * | 8/2009 | Dabiri | F42B 10/40 | 102/490 |
| 12,601,575 | B2 * | 4/2026 | Williams | F42B 10/40 | |
| 2025/0383188 | A1 * | 12/2025 | Williams | F42B 10/40 | |

FOREIGN PATENT DOCUMENTS

| | | | |
|---|---|---|---|
| FR | 2705144 | A1 | 11/1994 |
| GB | 1507865 | A | 4/1978 |
| KR | 101584488 | B1 | 1/2016 |
| WO | WO1998026249 | A1 | 6/1998 |
| WO | WO2024056988 | A1 | 3/2024 |

OTHER PUBLICATIONS

GB Search Report under Section 17(5) received for GB Application No. 2213429.0, dated Mar. 9, 2023. 3 pages.

* cited by examiner

RANGE EXTENSION DEVICE

FIELD

The present invention relates to an improved range extension device, particularly to a modular rocket assist device.

BACKGROUND

It is known to increase the range of fire for artillery shells, by generation of a mass flow in the near wake zone, known as base flow or base bleed. It is further known to use rocket assist motors on artillery shells to greatly enhance the range of a shell.

According to a first aspect of the invention there is provided a range extension device, capable in use of being reversibly engaged to an artillery carrier shell, said shell comprising a payload cavity, said range extension device comprising at least one energetic material charge, and an igniter, wherein the range extension device comprises a first region with an aperture which faces rearwardly away from the shell body, and second region with a closed end, wherein the closed end, in use, extends into the payload cavity of the carrier shell.

The range extension device may be selected from a rocket assist or base bleed device. Base bleed devices are well known devices, which are filled with an energetic material typically selected from a gas generator. They are ignited and are designed to infill, with gas, the vacuum created behind the shell as it traverses along its trajectory. The base bleed provides little to no thrust, it reduces drag of the shell by reducing the vacuum, thereby extending the range overall shell.

Highly preferably, the range extension device is a rocket assist motor, which in contrast to base bleed, are designed to provide significant thrust. The energetic material composition in a rocket assist motor is typically selected from a propellant that provides thrust.

The arrangement allows for a greater mass of rocket propellant to be used, as the extra rocket assist propellant extends into the payload cavity of the shell, whilst still being housed in the second region of the of the range extension device. Typically, prior art rocket assist systems have the rocket assist fixedly mounted to the exterior of the shell with no incursion into the payload cavity.

The range extender housing may be manufactured from high-strength, tempered steel, titanium, fibre reinforced composites or aluminium alloys.

The reversible engagement may be any quick release mechanism that allows the range extension device to be reversibly attached to the shell. The reversible engagement may be a thread, bayonet fitting, pins, highly preferably there are co-operative threaded portions on the range extension device and the carrier shell. Preferably, the co-operative thread is located on the first region of the range extension device.

The first and second regions of the range extension device may have the same outer diameter, however preferably, the outer diameter of the second region is less than the outer diameter of the first region, such that the second region may be located in the payload cavity with in the shell. The first region is preferably the same outer diameter as the shell body to preserve the aerodynamics of the shell.

The range extension device may be a rocket assist, the rocket assist device has a composition with a central core cavity, such that the composition burns from one or more internal surfaces in the cavity. Preferably, the internal cavity may be uniform along the length of the rocket assist device.

The second region may extend into the empty payload cavity, preferably greater than 5%, more preferably in the range of from 5 to 40% of the length of the empty payload cavity. Preferably, the outer diameter of the second region has an engineering fit with internal diameter of the empty payload cavity.

The extension of the rocket assist into the payload cavity allows for a greater mass of rocket assist propellant to be used, rather than adding further length to the exterior of the shell. The second region when located in the payload cavity provides further support for the rocket assist device, clearly greater than 40% insertion may be envisaged, but high percentages over 80% insertion would leave only a very small payload cavity.

The range extension device may be modular, such that further devices such as further second regions, may be added inside the payload cavity to increase the amount of energetic material for the range extension device. Preferably the rocket assist may have further modular devices that may be added inside the payload cavity. The ability to select further range extension may provide a tactical advantage for certain payloads.

Preferably the composition in the first region is separated from the composition in the second region by a spacer, said spacer comprising an aperture therethrough, to allow the combustion of the rocket motor composition in the first region. The rocket motor composition in the first and second region may be independently ignited. The rocket motor composition in the first and second region may be independently selected from different or the same compositions. The burn profile of the rocket motor composition in the first and second region may be independently selected, such as, for example by selecting the geometry i.e. shape of the internal cavity of the solid propellant that forms the burning front in the rocket assist. Geometries in propellants are well known, such as for example, star shapes etc.

The use of a spacer (between the first and second region) may provide structural rigidity to the rocket assist device, the bulkhead between the two regions may sit underneath the driving band to support the shell during rifle engagement. The spacer may stop/reduce plastic deformation of the rocket assist device. This may reduce damage to the propellant, but also prevents the rocket assist housing from deforming into the wall of the shell. It may be desirable that the rocket assist carrier shell's cavity is capable of carrying an expellable payload, therefore there is a requirement to be able to eject the rocket assist unit as well the payload. The rocket assist housing, if plastically deformed (i.e. sticking to) the wall of the shell would prevent facile ejection of the payload and rocket assist device.

According to a further aspect of the invention, there is provided an artillery common carrier shell comprising a main shell body, a fuze and located therebetween an ogive portion, said main shell body and ogive section forming a payload cavity, said cavity capable of receiving a payload, wherein the rear of the shell comprises a reversibly engaged range extension device as defined herein, wherein the second region of said range extension device extends into said payload cavity.

In one arrangement the payload may be a modular payload, such that increments of payload can be added and removed, to allow the insertion of the second region of the range extension device.

Preferably, the range extension device's first region, which is exterior to the shell, may have an outer diameter substantially the same as the outer diameter of the shell, so as to preserve the aerodynamics of the shell.

The shell may be a common carrier shell, capable of receiving multiple types of payload, such as for example, it may be selected for different tasks, for example a high explosive, illumination and/or smoke ammunition. The provision of a modular tail unit, a reversible range extension device, provides flexibility of range, as well as payload selection. The ability to remove the range extension device allows for the payload to be loaded from the rear of the munition.

The weapon barrels may be dimensioned in different sizes, the range extension devices may be fitted any calibre shell that comprises a payload cavity, typically medium or large calibre shells, such as, for example 20-40 mm, or 100-155 mm, respectively.

The invention therefore allows the range of a projectile to be changed on site at short notice.

The prior art systems, typically require specific shell bodies to receive either a boat tail, a base bleed, or a rocket assist.

BRIEF DESCRIPTION OF THE FIGURES

Embodiments of the invention will now be described by way of example only with reference to the figures, in which.

DETAILED DESCRIPTION

Figure 1:
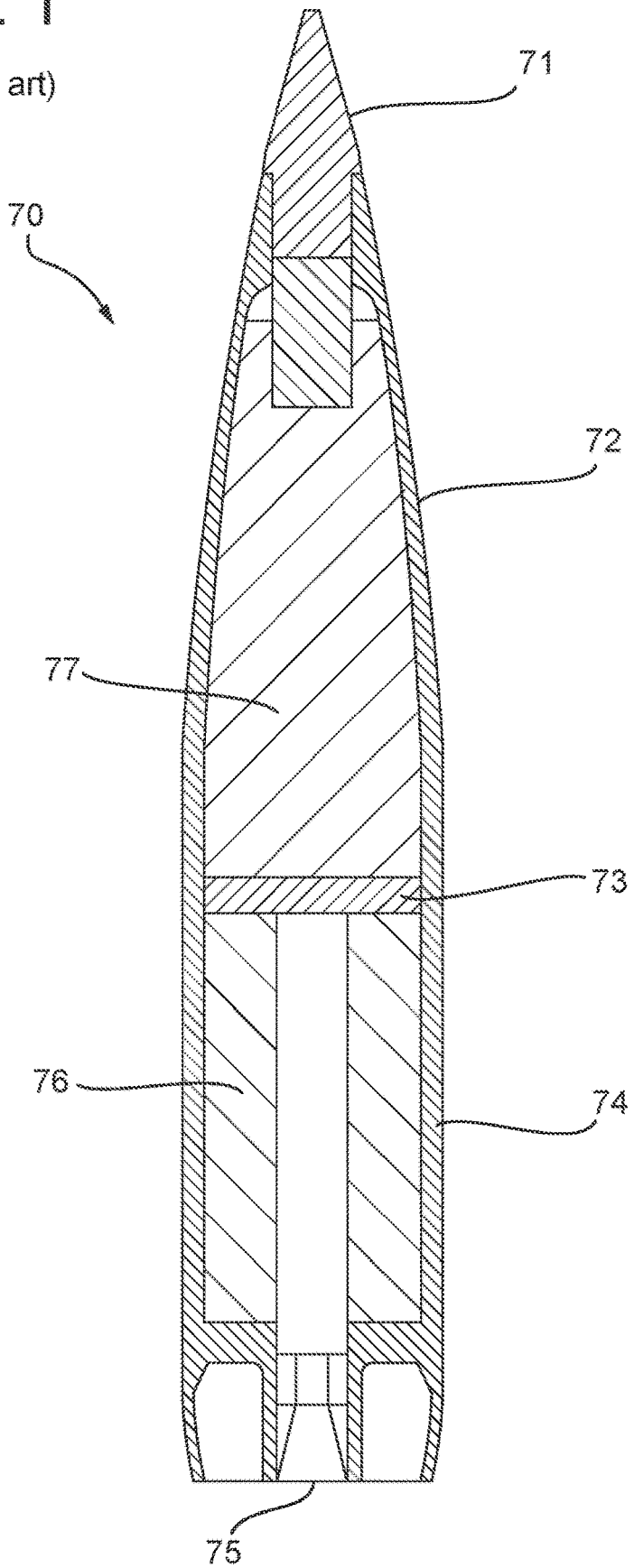
Fig. 1 (Prior art)
FIG. 1 shows a prior art rocket assist device.

Turning to FIG. 1, shows a prior art rocket assist shell 70. The shell body 72 and rocket assist motor 74 are a unified body, which cannot be separated to leave a shell capable of being fired. The rocket motor 74 comprises a rocket propellant 76, which when ignited exits via the plenum chamber 75, to provide thrust. The shell 72 cannot be detached from the motor 74, so there is no means to swap over the payload 77. The shell payload is therefore fixed at the point of manufacture. The shell cannot be converted to a standard range munition, once the shell is launched the rocket assist will function to extend the range.

Figure 2:
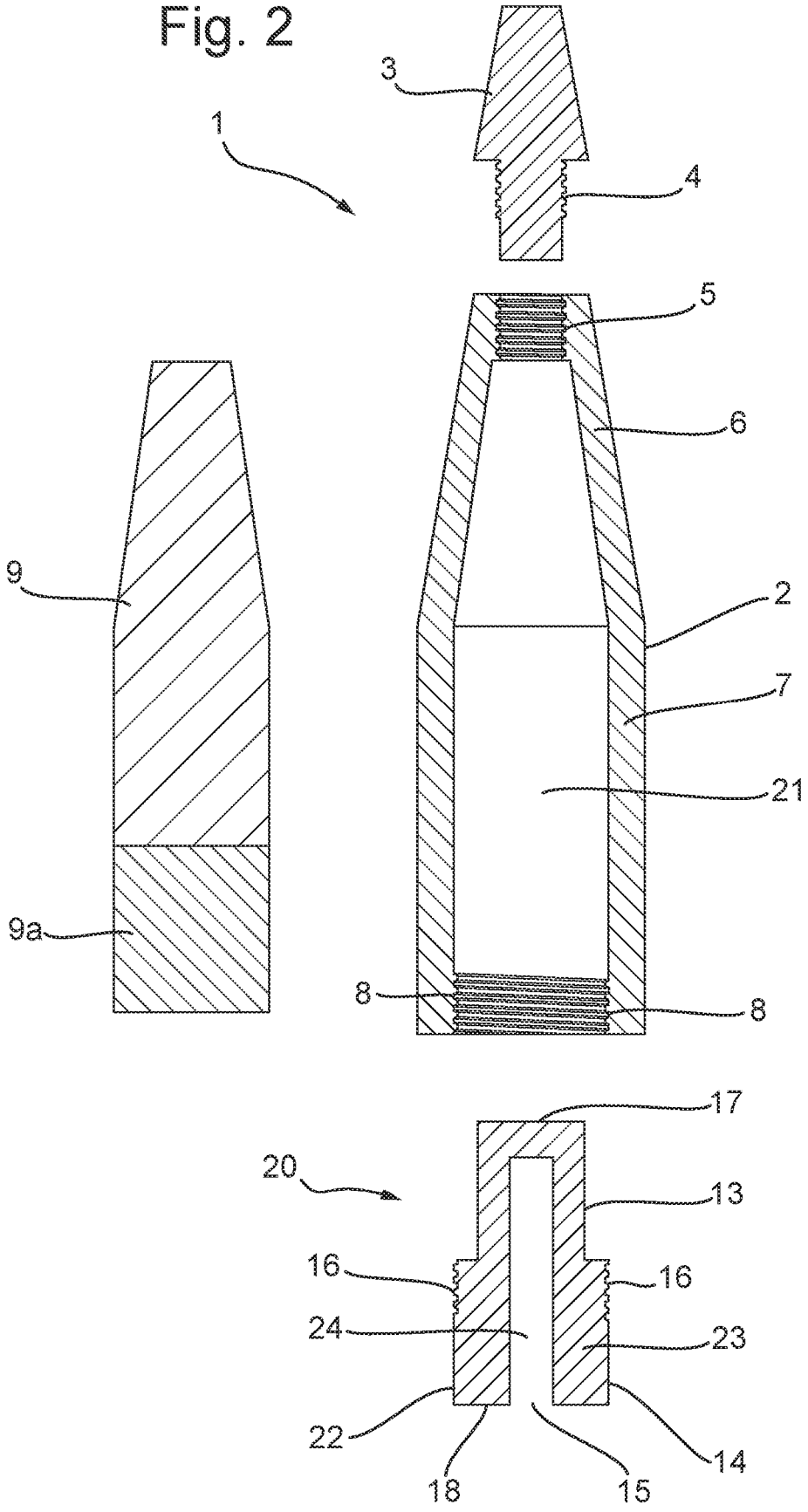
FIG. 2 shows the rocket assist device according to the invention.

Turning to FIG. 2 shows a common carrier shell 1, with a shell body 2, fuze 3, and a reversibly engaged range extension device 20. The shell body 2, comprises an ogive portion 6, and main body 7 to provide an empty cavity 21. The shell body 2 is shown as a unitary shell (compared to the spit shell in FIG. 3). The empty cavity 21 is filled with a modular payload 9, 9*a*, which can be a high explosive fill, illumination, smoke, electronic, UAV, or any other desired payload. The modular payload 9, 9*a* may be inserted into the empty cavity 21 from the rear of the shell body 2.

At the front end of the shell body 2, the fuze 3 typically comprises a threaded portion 4, which engages with the threaded portion 5 on the front end of the shell.

The reversibly engaged range extension device 20, comprises a rocket assist device 22, which is formed from a first region 14 and second region 13.

The aperture 15 of the first region 14 is directed towards the main propellant charge (not shown). Thereby upon ignition of the main charge propellant, the hot gases and particulates may cause the ignition of the rocket assist composition 23. Alternatively the rocket assist device 22 may have its own ignitor (not shown). A bunged nozzle may be used (not shown), and an igniter may be placed on the aft wall, with a delay mechanism that activates the ignitor after a specified period of time. The hot gas generation within the rocket chamber will then expel the bung.

The rocket assist composition 23 comprises a central core in the form of a uniform cavity 24 to ensure a consistent burn. The shape of the central core may be any well-known shape.

The cavity 24 or the composition 23 may be made uniform thickness, depending on the result to be achieved.

The closed end 17 of the second region 13, is located towards and sits inside the cavity 21 of the shell body 2.

The first region 14 comprises threaded portions 16 which reversibly attach with threads 8 on the shell body 2. The threads may be located on the second region.

The extension payload section 9*a*, may be separated from the payload 9, to allow the range extension device's 20 second region 13 to be inserted into the payload cavity 21.

Figure 3:
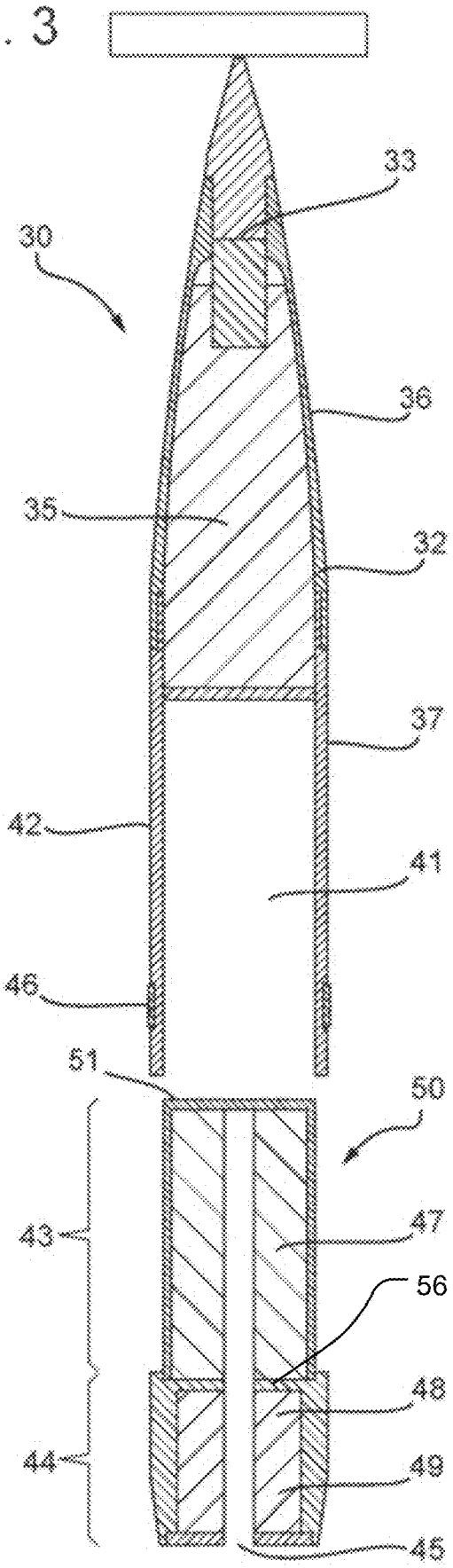
FIGS. 3 and 4 show the rocket assist motor engaged with the shell body.
Figure 4:
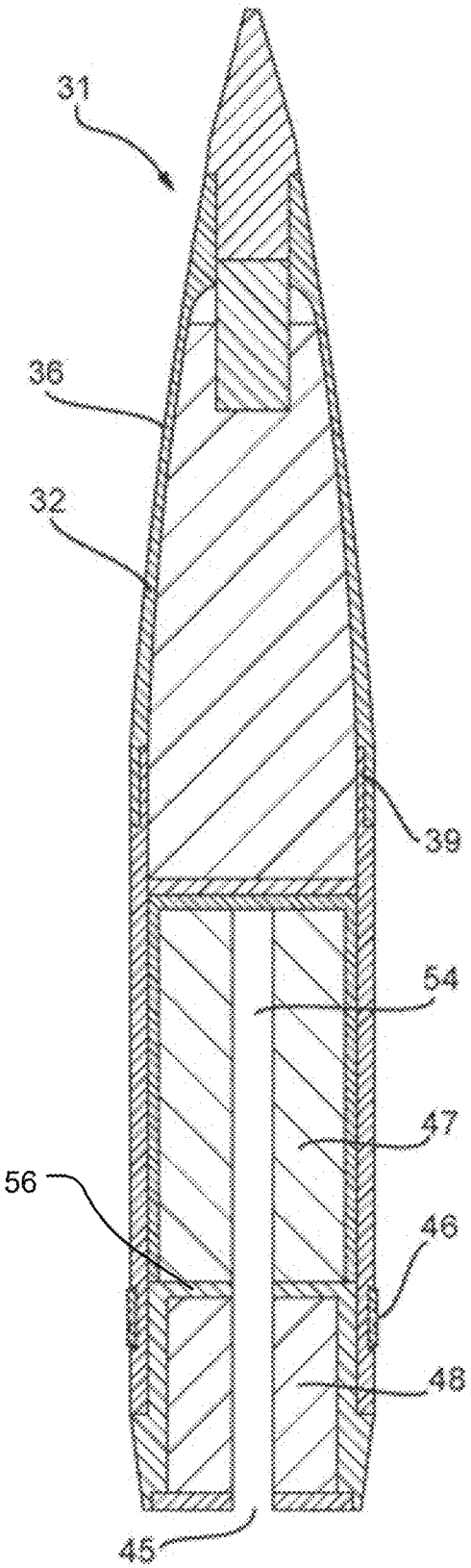

Turning to FIGS. 3 and 4 shows a rocket assist motor in separated form 30 and a loaded or engaged form 31 in a shell body 32. The common carrier shell 30, 31 comprises a shell body 32, fuze 33, and a reversibly engaged range extension device 50. The shell body 32 is a split shell, comprising an ogive portion 36, which has a screw thread 39 to join with the main body 37. The ogive portion 36 and main body 37 form the shell body 32, forming an empty payload cavity 41 therein. The empty cavity 41 is filled with a modular payload 39, which can be a high explosive fill, illumination, smoke, electronic, UAV, or any other desired payload. The modular payload 39, may be inserted into the empty cavity 41 from the rear of the shell body 32.

The reversibly engaged range extension device 50, comprises a rocket assist device 49, which is formed from a first region 44 and second region 43 separated by a spacer 56 having an aperture therethrough.

The aperture 45 of the first region 44 is directed rearwardly towards the main propellant charge (not shown). Thereby upon ignition of the main charge propellant, the hot gases and particulates may cause the ignition of the rocket assist composition 47, 48. Alternatively the rocket assist device 49 may have its own ignitor (not shown). A bunged nozzle may be used (not shown), and an igniter may be placed on the aft wall, with a delay mechanism that activates after a specified period of time. The hot gas generation within the rocket chamber will then expel the bung.

The rocket assist composition 47, 48 comprises a uniform cavity 54 to ensure a consistent burn. The cavity 54 or the composition 47, 48 may be made uniform thickness, depending on the result to be achieved. The closed end 51 of the second region 43, is located towards and sits inside the cavity 41 of the shell body 42. The first region 44 comprises threaded portions, which reversibly attach by a reversible attachment means in the form of threads on the shell body 42.

The driving band 46 is located towards the rear of the shell body 42, so as to impart spin to the shell upon gun launch.

Figure 5:
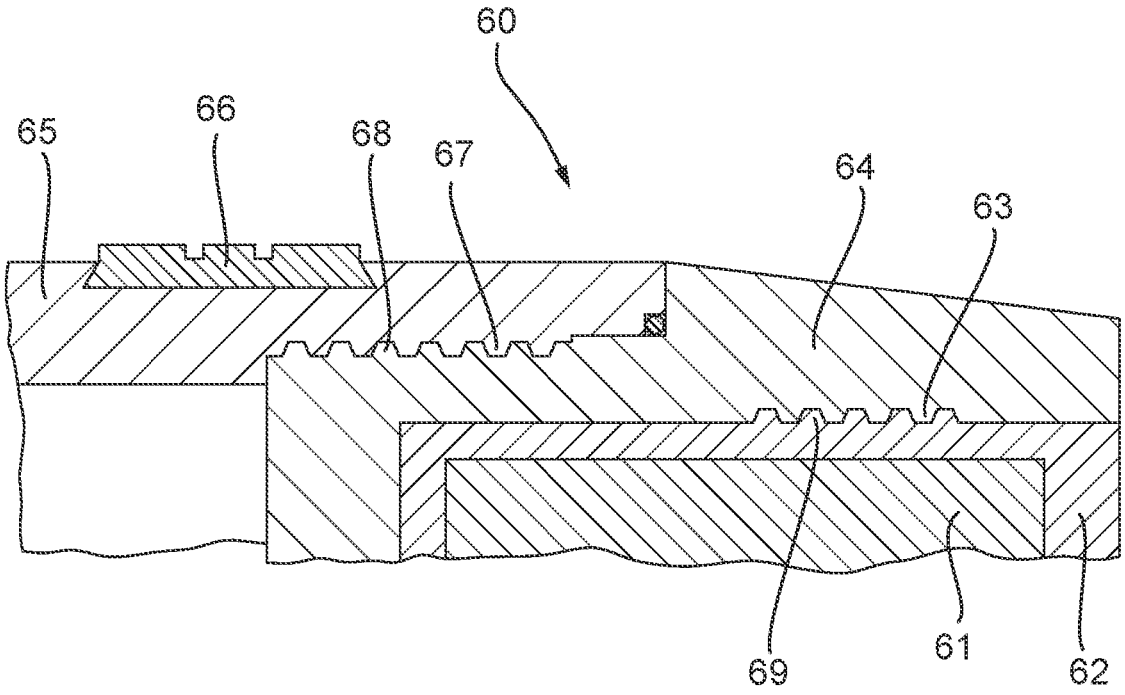
FIG. 5 shows a section of the motor reversibly engaged via a threaded connector to the shell body.

Turning to FIG. 5, there is provided a first region of the rocket assist 60, showing a section of the shell body 65 and driving band 66. The rocket assist housing 64 is reversibly engaged with the shell body 65 by co-operative threads 67, 68. The rocket assist motor 62 is reversibly engaged with the rocket assist housing 64, by co-operative threads 64, 69. The rocket assist motor 62 comprising a rocket propellant 61.

The co-operative threads may be replaced by shear pins or other fasteners.

The invention claimed is:

1. An artillery common carrier shell comprising:

a main shell body;

a fuze; and an ogive portion located between the main shell body and the fuse, the ogive portion forming a payload cavity capable of receiving a payload, wherein a rear of the artillery common carrier shell comprises a reversibly engaged range extension device, capable in use of being reversibly engaged to the body of the artillery common carrier shell, said range extension device comprising a rocket assist device having:

a first region with an aperture which faces rearwardly;

a second region with a closed end, wherein the second region is configured to extend into the payload cavity of the carrier shell; and at least one energetic material charge within the first region and the second region, the at least one energetic material including a rocket assist composition that provides thrust, the rocket assist composition having a uniform central cavity through the first region and the second region and adjacent to the aperture of the first region to ensure a consistent burn of the rocket assist composition, wherein an outer diameter of the second region is less than an outer diameter of the first region such that the second region can be extended into the payload cavity of the carrier shell.

2. The artillery common carrier shell according to claim 1, wherein a body of the range extension device is manufactured from steel, titanium, fibre reinforced composite, or aluminium alloy.

3. The artillery common carrier shell according to claim 1, wherein the range extension device reversible engagement comprises co-operative threads with the shell body.

4. The artillery common carrier shell according to claim 3, wherein the co-operative thread on the range extension device is located on the first region.

5. The artillery common carrier shell according to claim 1, wherein the second region extends into the payload cavity in a range of from 5 to 40% of a length of the payload cavity, the length being the length of the payload cavity when the payload cavity is empty.

6. The artillery common carrier shell according to claim 1, wherein a composition in the first region is separated from a composition in the second region by a spacer, said spacer comprising an aperture therethrough.

7. The range extension device artillery common carrier shell according to claim 1, wherein the range extension device is modular and configured such that further second region devices can be added inside the payload cavity to increase the amount of energetic material for the range extension device.

8. The artillery common carrier shell according to claim 1, wherein the first region of the range extension device has an outer diameter substantially the same as an outer diameter of the main shell body.

9. The artillery common carrier shell according to claim 1, wherein the outer diameter of the second region has an engineering fit with an internal diameter of the payload cavity.

10. The artillery common carrier shell according to claim 1, wherein the payload is a modular payload, such that increments of payload can be added and removed, to allow the insertion of the second region of the range extension device.

11. A range extension device, capable in use of being reversibly engaged to a body of an artillery carrier shell, said shell comprising a payload cavity, said range extension device comprising:

a first region with an aperture which faces rearwardly;

a second region with a closed end, wherein the second region is configured to extend into the payload cavity of the carrier shell; and at least one energetic material charge within the first region and the second region, the at least one energetic material including a rocket assist composition that provides thrust, the rocket assist composition having a uniform central cavity through the first region and the second region and adjacent to the aperture of the first region to ensure a consistent burn of the rocket assist composition, wherein an outer diameter of the second region is less than an outer diameter of the first region.

12. The range extension device according to claim 11, wherein the range extension device is modular and configured such that further second region devices can be added inside the payload cavity to increase the amount of energetic material for the range extension device.

* * * * *